US009832561B2

(12) United States Patent
Morris et al.

(10) Patent No.: US 9,832,561 B2
(45) Date of Patent: Nov. 28, 2017

(54) DETACHABLE AUDIO SYSTEM FOR HEAD-MOUNTED DISPLAYS

(71) Applicant: Oculus VR, LLC, Menlo Park, CA (US)

(72) Inventors: Quintin Morris, Issaquah, WA (US); James Stocker Webb, Seattle, WA (US); Mark Shintaro Ando, Seattle, WA (US); Peter Wesley Bristol, Seattle, WA (US); David Tao, Santa Clara, CA (US)

(73) Assignee: Oculus VR, LLC, Menlo Park, CA (US)

( * ) Notice: Subject to any disclaimer, the term of this patent is extended or adjusted under 35 U.S.C. 154(b) by 0 days.

(21) Appl. No.: 15/172,066

(22) Filed: Jun. 2, 2016

(65) Prior Publication Data

US 2016/0366502 A1 Dec. 15, 2016

Related U.S. Application Data

(60) Provisional application No. 62/273,358, filed on Dec. 30, 2015, provisional application No. 62/174,298, filed on Jun. 11, 2015.

(51) Int. Cl.
*H04R 25/00* (2006.01)
*H04R 1/10* (2006.01)

(52) U.S. Cl.
CPC ..... *H04R 1/1066* (2013.01); *H04R 1/105* (2013.01); *H04R 2499/15* (2013.01)

(58) Field of Classification Search
None
See application file for complete search history.

(56) References Cited

U.S. PATENT DOCUMENTS

| | | | | |
|---|---|---|---|---|
| 6,369,952 | B1 * | 4/2002 | Rallison | G02B 27/017 359/630 |
| 2008/0279409 | A1 * | 11/2008 | Hupkes | H04R 1/1066 381/370 |
| 2011/0044463 | A1 * | 2/2011 | DiRusso | H04R 1/105 381/71.6 |
| 2012/0207320 | A1 * | 8/2012 | Avital | H04R 1/1041 381/74 |
| 2014/0036127 | A1 * | 2/2014 | Pong | H04R 1/028 348/333.01 |

(Continued)

*Primary Examiner* — Joseph Saunders, Jr.
*Assistant Examiner* — James Mooney
(74) *Attorney, Agent, or Firm* — Perkins Coie LLP

(57) ABSTRACT

A detachable audio system with an interface plate mounted on a head strap, and a mounting plate assembly removably attachable to the interface plate with a portion of the strap between the plates to provide independent electrical and mechanical connections between the plates. The mounting plate assembly connects to an earbud assembly via a flexible audio cable. The mounting plate assembly has a threaded attachment member that mates with a threaded attachment member on the interface plate. A pair of electrical connectors on opposing sides of the threaded attachment member protrude from spaced apart cylindrical bosses, such that when the mounting plate is attached to the interlace plate, independent mechanical and electrical connections are provided for detachable retention and operation of the earbud assembly.

20 Claims, 14 Drawing Sheets

(56) References Cited

U.S. PATENT DOCUMENTS

2015/0296285 A1* 10/2015 Proos ..... H04R 1/105
381/333
2016/0277828 A1* 9/2016 Oh ..... H04R 1/105

* cited by examiner

DETACHABLE AUDIO SYSTEM FOR HEAD-MOUNTED DISPLAYS

CROSS-REFERENCE TO RELATED APPLICATION(S)

This application claims priority to U.S. Provisional Patent Application Ser. No. 62/174,298, filed Jun. 11, 2015, entitled "Detachable Audio System for Head-Mounted Displays," and U.S. Provisional Patent Application No. 62/273,358, filed Dec. 30, 2015, entitled "Detachable Audio System for Head-Mounted Displays," both of which are incorporated in their entireties by reference thereto.

TECHNICAL FIELD

This application relates generally to wearable technology and virtual-reality technology, including but not limited to a detachable audio system for a head-mounted strap, such as with a head-mounted display assembly.

BACKGROUND

Virtual-reality head-mounted displays have wide applications in various fields, including engineering design, medical surgery practice, military simulated practice, and video gaming. For example, a user wears a virtual-reality head-mounted display integrated with audio headphones while playing video games so that the user can have an interactive experience in an immersive virtual environment.

However, it may be difficult for a user to properly adjust and comfortably wear the head-mounted displays and the integrated audio systems using the existing technology, which may negatively affect the user's experience.

BRIEF DESCRIPTION OF THE DRAWINGS

For a better understanding of the various described embodiments, reference should be made to the Detailed Description below, in conjunction with the following drawings. Like reference numerals refer to corresponding parts throughout the figures and descriptions.

FIGS. 6A-6D are side views illustrating decoupling mechanisms between a coupling subsystem and a strap in accordance with some embodiments.

DETAILED DESCRIPTION

Overview

Figure 1:
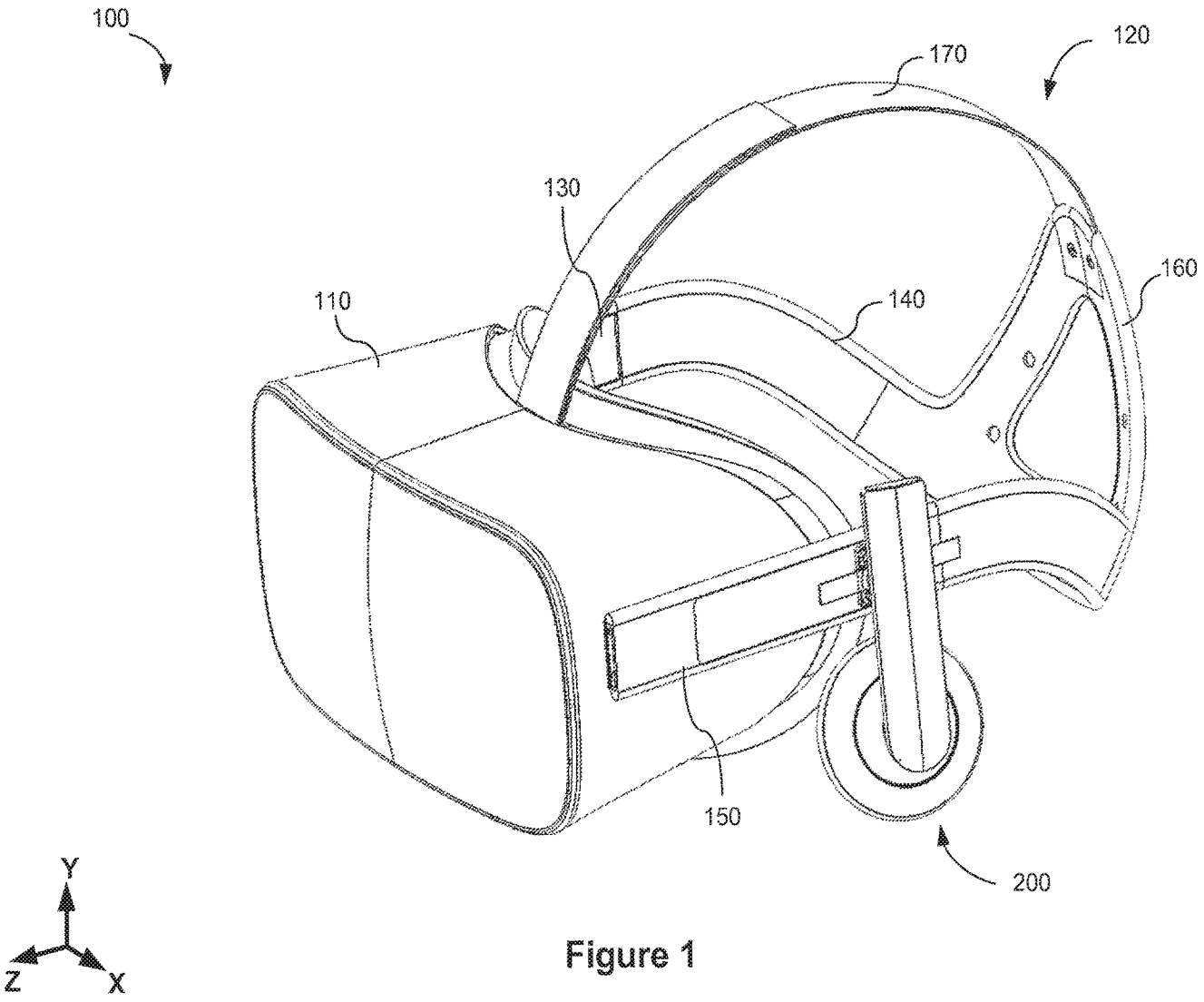
FIG. 1 is a perspective view of a head-mounted display system comprising a head-mounted display integrated with a detachable audio subsystem in accordance with an embodiment of the present disclosure.

A detachable audio system usable with a head-mounted display system or other strap mounted system is disclosed. The system comprises a mounting plate assembly mounted on the strap, and a second mounting plate assembly is removably attachable to the first mounting plate with a portion of the strap between the plates to provide independent electrical and mechanical connections between the plates. The second mounting plate assembly is connected to an earbud assembly or other speaker assembly via a flexible audio cable. The second mounting plate assembly has a threaded attachment member that mates with a threaded attachment member on the first mounting plate. A pair of electrical connectors are on opposing sides of the threaded attachment member and protrude from cylindrical bosses projecting from the planar strap engaging surface. When the first and second mounting plates are attached, an electrical connection is provided for operation of the earbud assembly.

General Description

Reference will now be made to embodiments, examples of which are illustrated in the accompanying drawings. In the following description, numerous specific details are set forth in order to provide an understanding of the various described embodiments. However, it will be apparent to one of ordinary skill in the art that the various described embodiments may be practiced without these specific details. In other instances, well-known systems, methods, procedures, components, circuits, and networks have not been described in detail so as not to unnecessarily obscure aspects of the embodiments.

It will also be understood that, although the terms first, second, etc. are, in some instances, used herein to describe various elements, these elements should not be limited by these terms. These terms are used only to distinguish one element from another. For example, a first segment could be termed a second segment, and, similarly, a second segment could be termed a first segment, without departing from the scope of the various described embodiments. The first segment and the second segment are both segments, but they are not the same segment.

The terminology used in the description of the various embodiments described herein is for the purpose of describing particular embodiments only and is not intended to be limiting. As used in the description of the various described embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

In at least one embodiment, a detachable audio system coupleable to a strap is provided. The system has a first mounting plate assembly with a first plate portion attachable to the strap, first and second electrical contacts connected to the first plate portion and spaced apart from each other, and a first threaded attachment member connected to the first plate portion and spaced apart from the first and second electrical contacts. A second mounting plate assembly has a second plate portion removably connectable to the first mounting plate assembly with at least a portion of the strap therebetween. A second threaded attachment member projects from the second plate portion and is configured to threadably mate with the first threaded attachment member to mechanically hold the first and second mounting plate assemblies together on the strap. First and second electrical connectors are connected to the second plate portion and positioned to engage the first and second electrical contacts when the first and second threaded attachment members are in threaded engagement. A speaker assembly is coupled to the second mounting plate assembly, with the speaker assembly and the second mounting plate assembly being detachable from the strap as a unit.

Another embodiment provides a detachable audio system coupleable to a strap, comprising a first mounting plate assembly having a first plate portion attachable to the strap, first and second electrical contacts spaced apart from each other and connected to the first plate portion, and a first threaded attachment member connected to the first plate portion and spaced apart from the first and second electrical contacts. A second mounting plate assembly has a second plate portion removably connectable to the first mounting plate assembly with at least a portion of the strap therebetween. The second mounting plate assembly has an outer plate structure with a receiving area, a non-conductive insert in the receiving area, and a second threaded attachment member projecting from the outer plate structure through the non-conductive insert. The second threaded attachment member is configured to screw together and threadably mate with the first threaded attachment member to mechanically hold the first and second mounting plate assemblies together on the strap. First and second spring-biased electrical connectors are at least partially captured between the non-conductive insert and the outer plate structure with contact tips protruding through the insert and positioned to engage the first and second electrical contacts when the first and second threaded attachment members are in threaded engagement. The second mounting plate assembly has a flex circuit connected to the insert in operative engagement with the spring-biased electrical connectors. A flexible strain relief member is attached to the outer plate structure. The flexible strain relief member has an internal channel with a first end adjacent to the flex circuit and a second end spaced apart from the flex circuit. An electrically conductive line extends through the internal channel and is connected at a proximal portion to the flex circuit. A speaker assembly is attached to a distal portion of the electrically conductive line. The ear bud assembly, the electrically conductive line and second mounting plate assembly are detachable from the strap as a unit upon unscrewing the first and second threaded attachment members.

FIG. 1 is a perspective view of a head-mounted display system 100 in accordance with some embodiments. In some embodiments, the head-mounted display system 100 comprises a head-mounted display 110 integrated with an audio subsystem 200. Although not shown due to the perspective, the head-mounted system 100 may have two audio subsystems located on left and right sides to provide audio signals to the user's left and right ears. Each of the left and right audio subsystems may use substantially symmetric structures for coupling the speaker to a corresponding rigid segment of the strap 120. The audio subsystem 200 will be discussed in detail with reference to the following figures.

In some embodiments, the head-mounted display system 100 also comprises a strap 120 for mounting the head-mounted display 110 on a user's head. In the example of FIG. 1, the strap 120 comprises a rigid segment 130, a semi-rigid segment 140, and a rigid segment 150 that are coupled to each other to adjustably wrap around side and back portions of the user's head.

In some embodiments, the strap 120 comprises a single and continuous semi-rigid segment 140 including two arc portions, and each arc portion is to extend from above a user's ears to below the user's occipital lobe to conform to a portion of the user's head. Alternatively, the strap 120 may comprise two separate and symmetric semi-rigid segments each including an arc portion.

In some embodiments, the rigid segments 130 and 150 are coupled to the head-mounted display 110 and positioned on respective sides of the user's head to extend along the lateral dimension (e.g., Z dimension in FIG. 1). The strap 120 may further include flexible segments (not shown) that are stretchable within the rigid segments 130 and 150 respectively to adjust the strap 120 in accordance with the user's head.

In some embodiments, the strap 120 comprises a back piece 160 coupled with the semi-rigid segment 140 to rest against the back of the user's head (e.g., around the user's occipital lobe).

In some embodiments, the strap 120 comprises a top strap 170 coupled to the back piece 160 and the head-mounted display 110 to adjustably conform to the top of the user's head when the user is wearing the head-mounted display 110.

In some embodiments, various electrical connection mechanisms 180 (e.g., flat flexible circuits and/or electric cables) are used in the head-mounted display system 100 to provide power management and/or other functionalities to the head-mounted display 110 and the audio subsystem 200. For example, the head-mounted display 110 is integrated with the audio subsystem 200 using suitable electrical connection mechanisms 180 to provide both visual and audio virtual-reality experiences to the user.

Various embodiments of the strap system 120 and the head-mounted display system 100 are described in U.S.

patent application Ser. No. 14/603,335, filed on Jan. 22, 2015, and U.S. patent application Ser. No. 14/681,001, filed on Apr. 7, 2015, U.S. patent application Ser. No. 14/749,410 filed on Jun. 24, 2015, which claims priority to 62/174,359 filed on Jun. 11, 2015, all of which are incorporated herein by reference in their entireties.

Figure 2B:
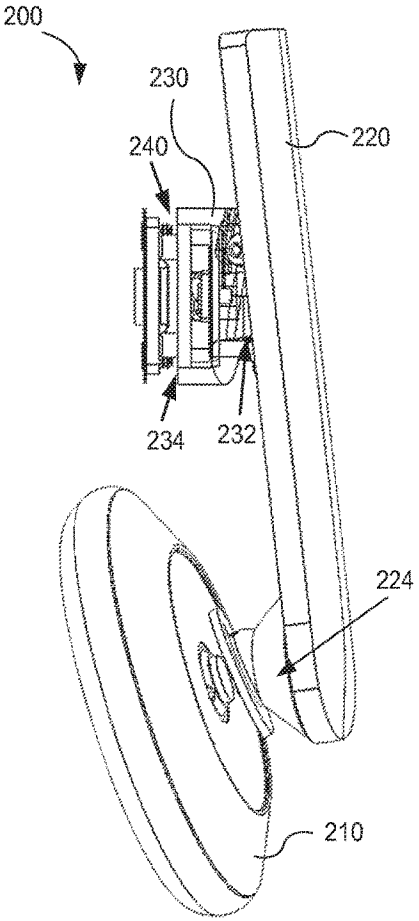
FIGS. 2A-2B are perspective views of an audio subsystem for a head mounted display system in accordance with some embodiments.
Figure 2A:
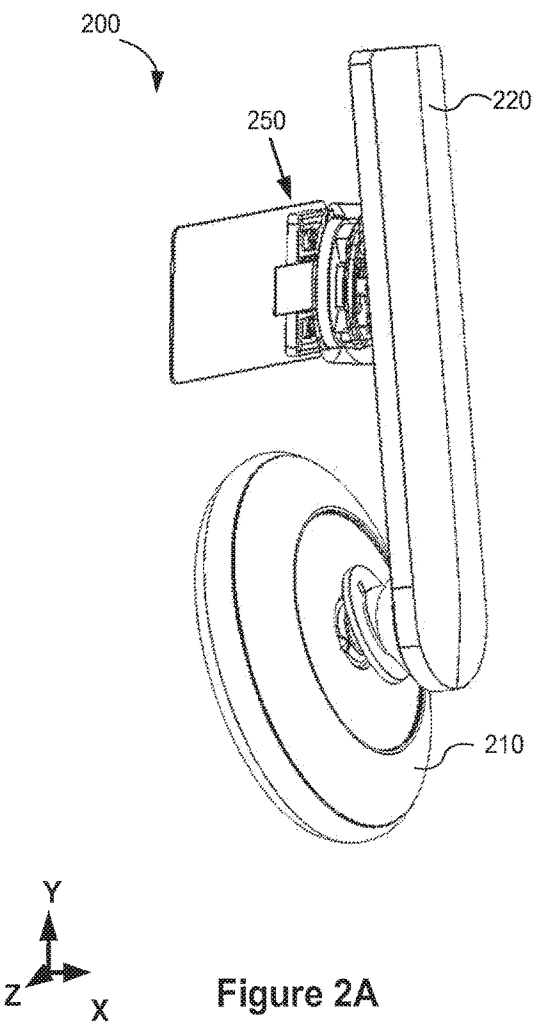

FIGS. 2A-2B are perspective views of the audio subsystem 200 for the head-mounted display system 100 in accordance with some embodiments. The audio subsystem 200 comprises a speaker 210, an arm 220 coupled to the speaker 210, a strap connector 230 coupled to the arm 220, and a coupling subsystem 240 coupled to the strap connector 230. The coupling subsystem 240 is releasably coupled to the strap 120 (e.g., the rigid segment 150) for the head-mounted display system 100 as illustrated in FIG. 1.

The speaker 210 may be an on-ear headphone speaker, an around-ear headphone speaker, an over-ear headphone speaker, an in-ear headphone speaker, an earbud speaker, or any other suitable style of speaker.

As shown in FIG. 2B, the strap connector 230 and the speaker 210 are coupled to the arm 220 in respective portions distributed along the length (e.g., Y dimension in FIGS. 2A-2B) of the arm 220. The arm 220 may further comprise a four-bar linkage to provide inward and outward movement of the speaker with respect to the user's ear. Various embodiments of the four-bar linkage and other possible structures of the arm 220 are described in U.S. patent application Ser. No. 14/627,639, filed on Feb. 20, 2015, the disclosure of which is incorporated herein by reference in its entirety.

The strap connector 230 includes a side 232 coupled to the arm 220 and a side 234 coupled to the coupling subsystem 240, and the side 232 and the side 234 are opposite to each other along the X dimension as illustrated in FIG. 2B. Various embodiments of the strap connector 230 are described in U.S. patent application Ser. No. 14/627,639.

Figure 3A:
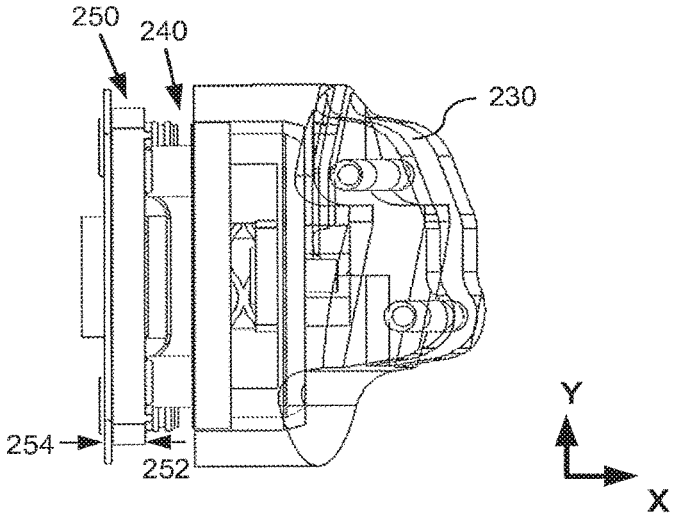
FIG. 3A is a side view of a strap connector coupled with a coupling subsystem in accordance with some embodiments.

FIG. 3A is a side view of the strap connector 230 coupled with the coupling subsystem 240 in accordance with some embodiments. FIG. 3A also illustrates a receiving structure 250 including a side 252 coupled to the coupling subsystem 240 and a side 254 to couple to the strap 120 (e.g., the rigid segment 150 of FIG. 1). The side 252 and the side 254 are opposite to each other along the X dimension as illustrated in FIG. 3A. In some embodiments, the receiving structure 250 is a component of the strap 120 (e.g., the rigid segment 150) that is fixedly connected to the strap 120. Alternatively, the receiving structure 250 is coupled to the strap 120 using any suitable structure; once coupled, the receiving structure 250 may be considered part of the strap 120.

Figure 3B:
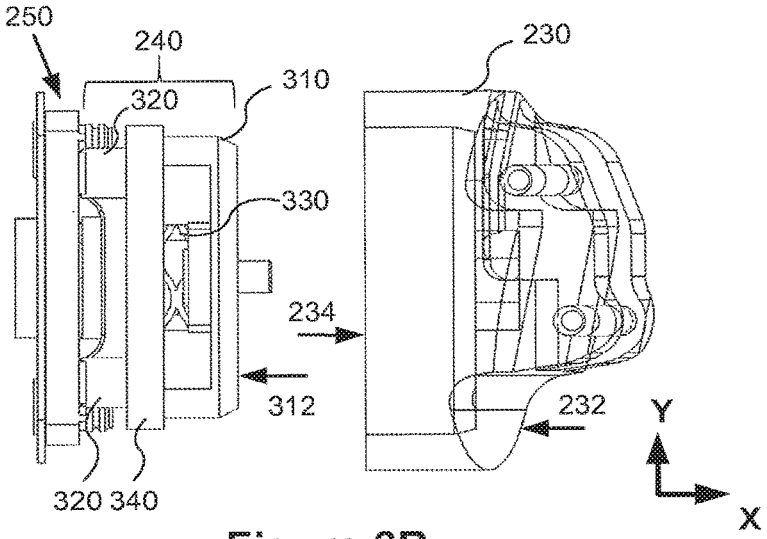
FIG. 3B is a side view of a strap connector and a coupling subsystem in accordance with some embodiments.

FIG. 3B is a side view illustrating the strap connector 230 decoupled from the coupling subsystem 240 in accordance with some embodiments. The coupling subsystem 240 comprises a base 310, one or more posts 320 (e.g., a pair of posts) extending from the base 310 and through a spacer 340 to couple to the receiving structure 250, and a spring 330 positioned between the base 310 and the spacer 340 to deform (e.g., to release from a compressed length to a natural length) to detach the coupling subsystem 240 from the receiving structure 250 when the posts 320 decouple from the receiving structure 250.

Figure 3C:
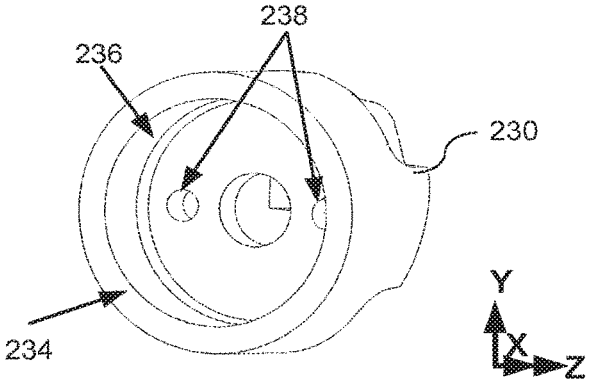
FIG. 3C is a perspective view of a strap connector in accordance with some embodiments.

FIG. 3C is a perspective view of the strap connector 230 in accordance with some embodiments. As shown in FIGS. 3A-3C, when the coupling subsystem 240 is coupled with the strap connector 230, a side 312 of the base 310 is engaged with a recessed portion 236 of the side 234 of the strap connector 230. For example, the side 312 of the base 310 is flush to engage with the recessed portion 236 of the side 234 of the strap connector 230. The strap connector 230 may further include one or more recessed portions 238 (e.g., circular recessed portions 238) on the side 234 and within the recessed portion 236 to receive coupling elements (e.g., screws) extending from the side 312 of the coupling subsystem 240 when the coupling subsystem 240 is engaged with the strap connector 230.

Figure 3D:
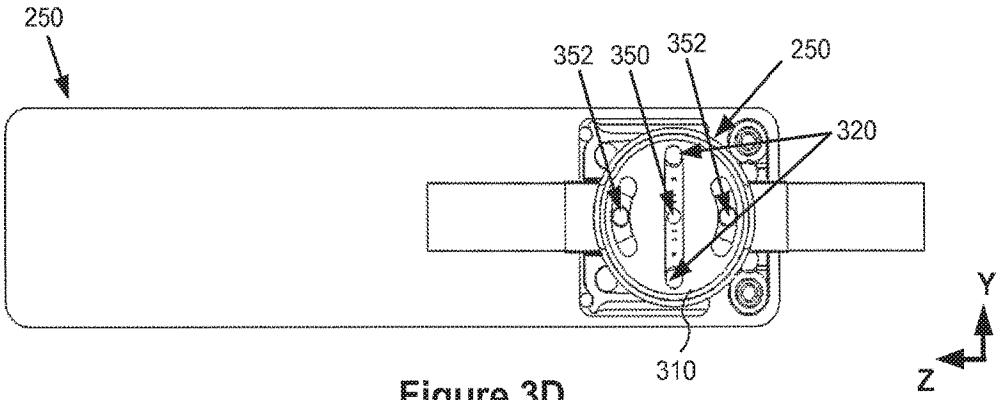
FIG. 3D is a top view of a coupling subsystem coupled with a receiving structure in accordance with some embodiments.

FIG. 3D is a top view of the coupling subsystem 240 coupled with the receiving structure 250 in accordance with some embodiments. As shown in FIG. 3D, one or more posts 320 are used to couple the coupling subsystem 240 with the receiving structure 250. Furthermore, the coupling subsystem 240 may include one or more coupling elements 350 and 352 (e.g., screws).

Figure 3E:
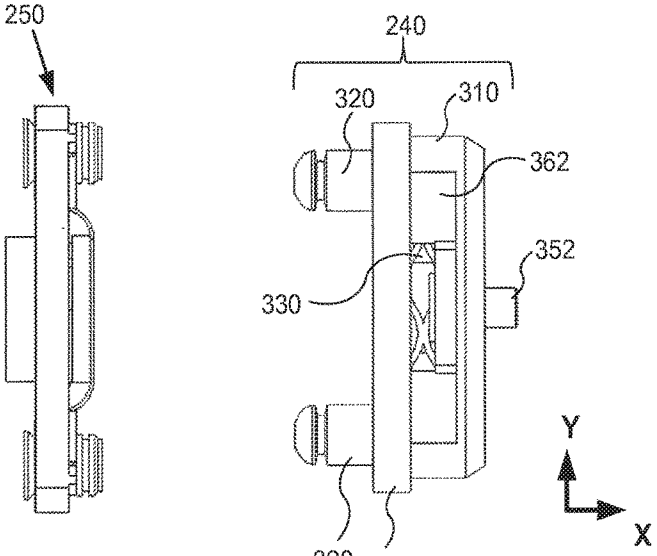
FIG. 3E is a side view of a coupling subsystem and a receiving structure in accordance with some embodiments.

FIG. 3E is a side view of the coupling subsystem 240 decoupled from the receiving structure 250 in accordance with some embodiments. As shown in FIG. 3E, the coupling subsystem 240 comprises the base 310, the one or more posts 320 to couple to the receiving structure 250, the spring 330 located between the spacer 340 and the base 310, and the one or more coupling elements 352 (e.g., screws) to couple the coupling subsystem 240 to the strap connector 230. Opposite ends of the spring 330 contact the spacer 340 and the base 310.

Figure 4A:
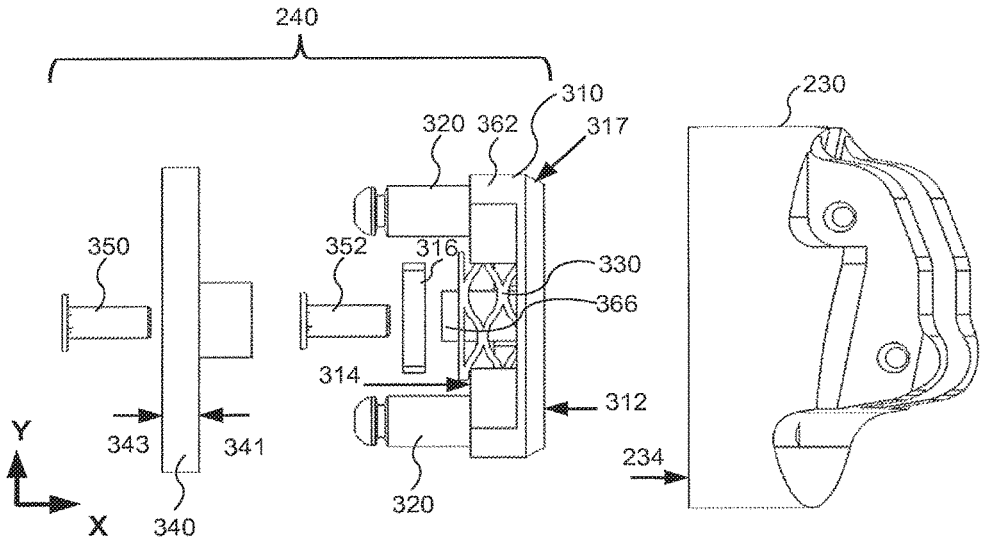
FIGS. 4A-4B are perspective views of components of a coupling subsystem and a strap connector in accordance with some embodiments.
Figure 4B:
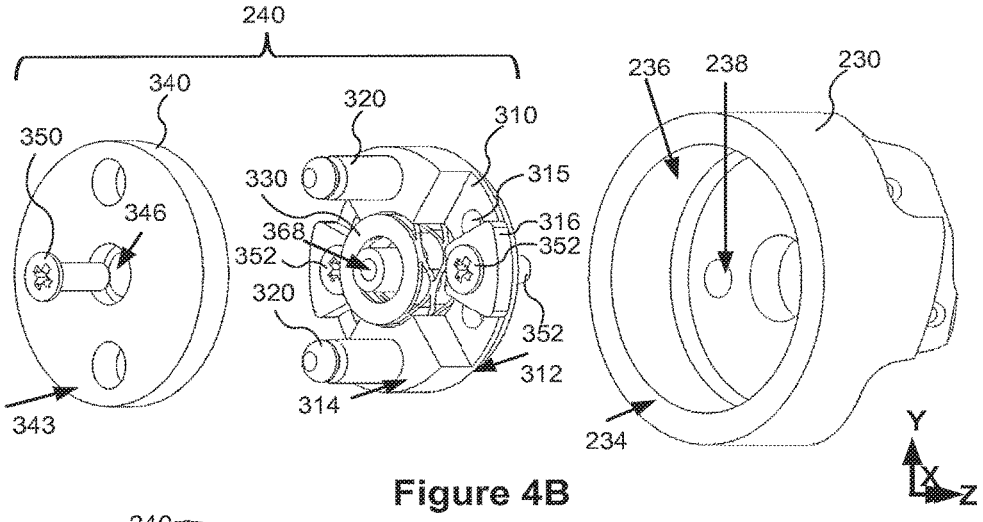

FIGS. 4A-4B are exploded views illustrating a plurality of components of the coupling subsystem 240 in accordance with some embodiments. In some embodiments, the base 310 is a circular boss to locate the coupling subsystem 240 within the recessed portion 236 of the strap connector 230.

The circular base 310 may have a tapered (e.g., beveled) side portion 317 near the surface on the side 312 of the circular base 310 facing the strap connector 230 as shown in FIG. 4A. The side 312 of the circular base 310 is configured to engage with the side 234 of the strap connector 230 as shown in FIG. 4B. The circular base 310 has an opposite side 314 to the side 312 along the X dimension as shown in FIGS. 4A-4B. The one or more posts 320 extend from the side 314 of the circular base 310 to couple to the strap 120 via the receiving structure 250 as shown in FIG. 3B.

In some embodiments, the strap connector 230 is rotatably coupled to the coupling subsystem 240. For example, the circular base 310 is rotatably coupled to the strap connector 230.

As shown in FIG. 4B, the spring 330 contacts the side 314 of the circular base 310 and is positioned between the circular base 310 and the spacer 340. The spring 330 changes its length to detach the coupling subsystem 240 (e.g., the spacer 340 and circular base 310) from the strap 120 when the plurality of posts 320 decouple from the receiving structure 250.

As shown in FIGS. 4A-4B, a plurality of coupling elements 352 are used to couple the circular base 310 to the strap connector 230. For example, the plurality of coupling elements 352 (e.g., screws) insert from the side 314 (i.e., opposite to the side 312 along X dimension) of the circular base 310 respectively. The coupling elements 352 respectively insert through a plurality of openings 315 in the circular base 310 and out from the side 312 of the circular base 310 (e.g., as shown in FIGS. 3E and 4B). When the circular coupling subsystem 240 is engaged with the strap connector 230, the coupling elements 352 respectively insert into the circular recessed portions 238 on the side 234 of the strap connector 230. For example, the coupling elements 352 include screws, bolts, or any other suitable fasteners.

Figure 4C:
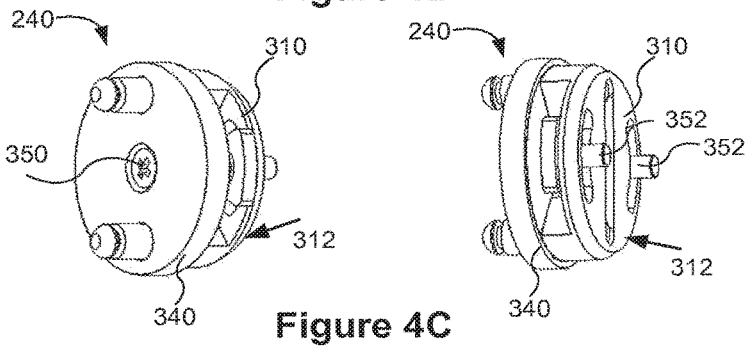
FIG. 4C shows perspective views of a coupling subsystem in accordance with some embodiments.

Still referring to FIGS. 4A-4B, a center coupling element 350 is used to couple the spacer 340 to the circular base 310. The spacer 340 includes a side 341 facing the circular base 310 and a side 343 opposite to the side 341 along the X dimension. In one example, the center coupling element 350 inserts from the side 343 of the spacer 340 through a center opening 346 of the spacer 340, into a center opening 368 of the circular base 310. The center coupling element 350 includes screws, bolts, or any other suitable fasteners. The side 343 of the spacer 340 may be flat. FIG. 4C shows perspective views of the coupling subsystem 240 in accordance with some embodiments. As shown in FIG. 4C, the center coupling element 350 may not extend out from the side 312 of the circular base 310 to reach the strap connector 230.

As shown in FIGS. 4A-4B, one or more spacers 316 are used between the coupling elements 352 and the circular base 310 and positioned against the side 314 of the circular base 310. The spacer 316 may have a shape that conforms to a portion of the circular base 310 (e.g., as shown in FIG. 4B), or any other suitable shape (e.g., circular). The spacers 316 may be used to provide an improved fit and a level surface between the coupling elements 352 and the circular base 310. The spacers 316 may also be used to fill gaps between the coupling elements 352 and the circular base 310 subject to wear.

Figure 5A:
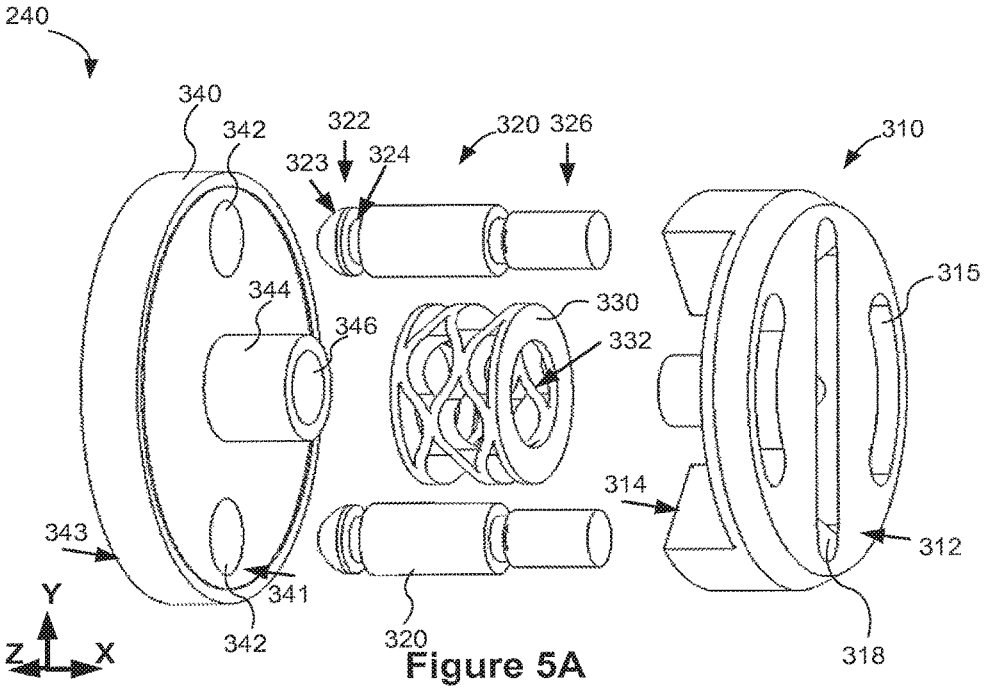
FIGS. 5A-5D are exploded views illustrating components of a coupling subsystem in accordance with some embodiments.
Figure 5B:
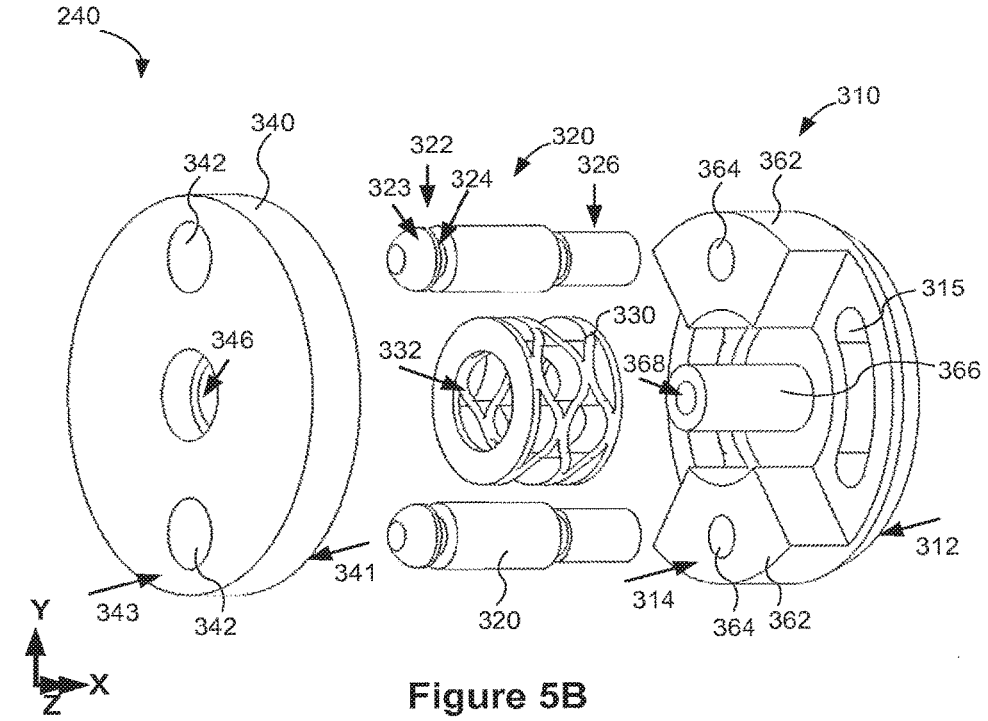
Figure 5C:
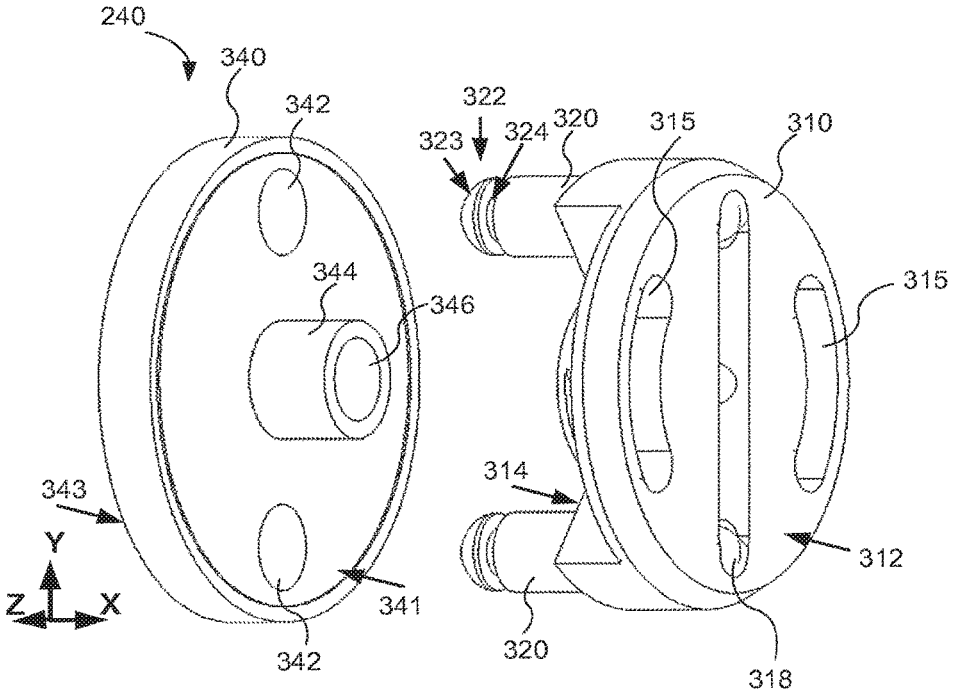
Figure 5D:
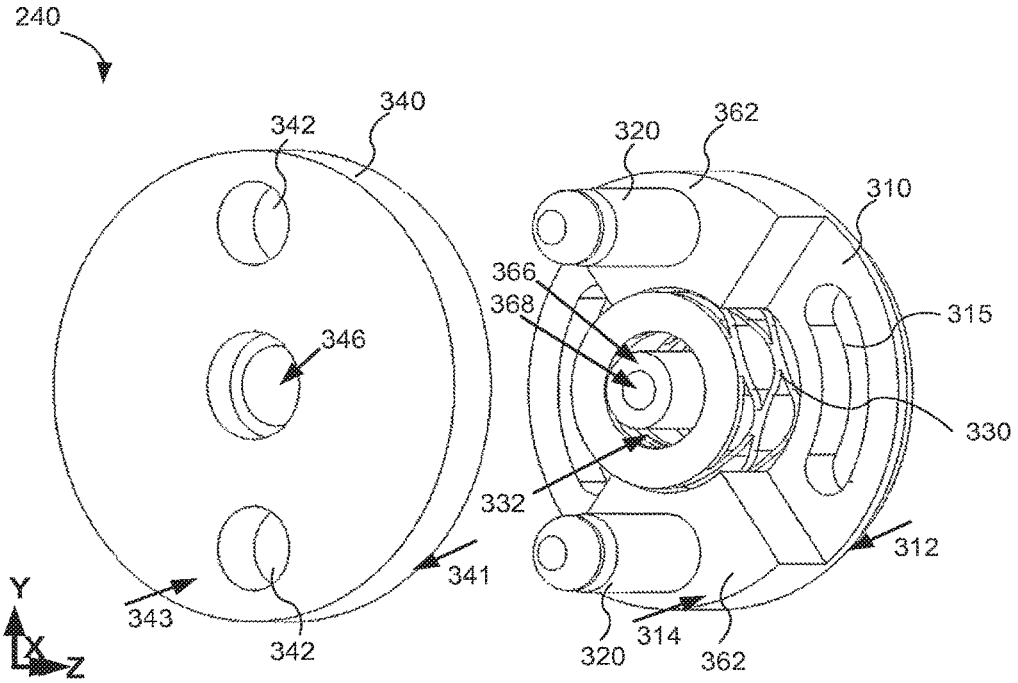

FIGS. 5A-5D are exploded views illustrating components of the coupling subsystem 240 in accordance with some embodiments. In some embodiments, the coupling subsystem 240 comprises a pair of posts 320. Each post 320 includes an end 326 (e.g., an elongated end) to be inserted into a respective opening 364 of a plurality of openings 364 in the circular base 310 as shown in FIG. 5B. A diameter of the end 326 is designed to fit tightly in the opening 364 such that the post 320 is fixedly held in the opening 364 of the circular base 310 as shown in FIG. 5D.

Each post 320 also includes an opposite end 322 to be inserted through an opening 342 of the spacer 340 and to couple to the strap 120. The end 322 includes a tip 323 to be inserted into a receiving portion on the strap 120 (e.g., an opening in the receiving structure 250). The end 322 also includes a groove 324 to engage with the receiving portion of the strap 120 (e.g., the groove 324 is to engage with concave edges of a latch in the receiving structure 250).

In some embodiments, each post 320 is circular. The groove 324 and the tip 323 of each post 320 are also circular. As shown in FIGS. 5A-5B, the diameter of the groove 324 is smaller than the diameter of the mid portion of the post 320, such that when the post 320 is coupled with the receiving structure 250, the post 320 is prevented from decoupling from the receiving structure 250.

In some embodiments as shown in FIG. 5B, each opening 364 of the plurality of openings 364 of the circular base 310 extends through a respective protrusion 362 of a plurality of protrusions 362 that protrude from the side 314 of the circular base 310. The respective protrusion 362 may have a shape that conforms to a portion of the circular base 310 or any other suitable shape.

In some embodiments as shown in FIG. 5B, the circular base 310 comprises a center opening 368 extending through a center protrusion 366 that protrudes from the side 314 of the circular base 310. The spring 330 has a hollow center 332, and the center protrusion 366 is inserted into the hollow center 332 of the spring 330 as shown in FIG. 5D. In some embodiments, as illustrated in FIG. 4A, the center protrusion 366 of the circular base 310 is longer than the respective protrusion 362 of the plurality of protrusions 362.

In some embodiments, referring back to FIG. 3E, when the spacer 340 is coupled with the circular base 310 (e.g., while the audio subsystem 200 is engaged with the strap 120), the spacer 340 rests against the plurality of protrusions 362 of the circular base 310. The spacer 340 includes a plurality of openings 342 through which the posts 320 are respectively inserted.

As shown in FIGS. 5A-5D, the spacer 340 includes a center protrusion 344 protruding from the side 341 of the spacer 340 and facing the circular base 310. The spacer 340 includes a center opening 346 through the center protrusion 344 of the spacer 340. When the spacer 340 is coupled with the circular base 310, the center protrusion 344 of the spacer 340 is inserted into the hollow center 332 of the spring 330, and the center protrusion 366 of the circular base 310 is inserted into the center opening 346 of the spacer 340.

In some embodiments, the circular base 310 includes a plurality of openings 315 and a center groove 318 on the side 312. The coupling elements 352 may insert through the respective openings 315 to couple the circular base 310 to the strap connector 230. As shown in FIGS. 5A-5B, the plurality of openings 364 are diagonally distributed on a first diagonal of the circular base 310, and the plurality of openings 315 are diagonally distributed on a second diagonal of the circular base 310, in accordance with some embodiments.

Figure 6A:
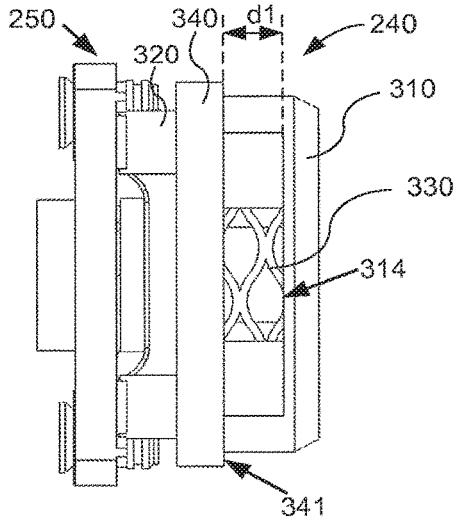
Figure 6B:
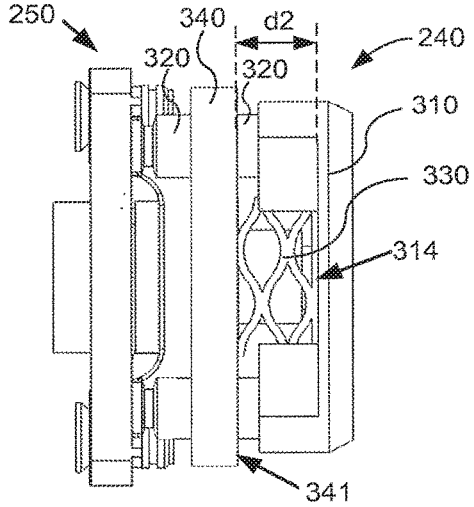
Figure 6C:
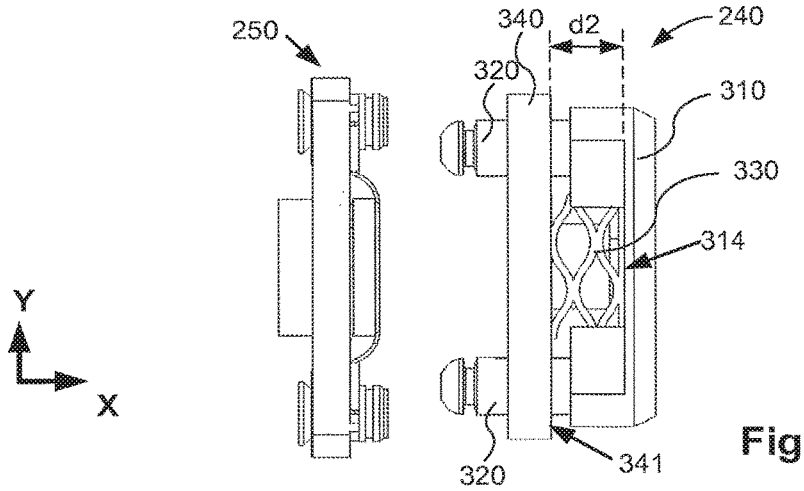

FIGS. 6A-6C are side views illustrating decoupling mechanisms between the coupling subsystem 240 and the strap 120 (e.g., the receiving structure 250 coupled to the strap 120) in accordance with some embodiments. The coupling element 350 (e.g., illustrated in FIG. 4C) may be used to couple the spacer 340 with the circular base 310 while allowing a relative movement along the X dimension between the spacer 340 and the circular base 310.

In some embodiments, the spring 330 has one end contacting the side 314 of the circular base 310 and the opposite end contacting the side 341 of the spacer 340. When the posts 320 are released from the receiving structure 250, the spring 330 deforms from a first state at a length of d1 to a second state at a length of d2, where d2 is greater than d1, such that the coupling subsystem 240 automatically detaches from the receiving structure 250. In one example, a natural length (unstretched and uncompressed) of the spring 330 is longer than a length of the center protrusion 344 of the spacer 340.

For example, the spring 330 has a natural length (i.e., an unstretched and uncompressed length) of d2. When the coupling subsystem 240 is coupled with the receiving structure 250, the spring 330 is in a compressed state with a length of d1. When the posts 320 are released from the receiving structure 250 (e.g., by releasing the grooves 324 from latches in the receiving structure), the spring 330 automatically changes from the compressed length d1 to the natural length d2. Simultaneously, the circular base 310 moves along the X dimension away from the spacer 340, and the coupling subsystem 240 detaches from the receiving structure 250. As illustrated in FIGS. 6A-6C, the distance between the side 314 of the circular base 310 and the side 341 of the spacer 340 increases from d1 to d2 as the spring 330 changes from the compressed state to the natural state.

In another example, the length d2 is not the natural length of the spring 330, but a length longer than the compressed length d1 and shorter than the natural length of the spring 330.

Reversibly, the detached coupling subsystem 240 can couple to the receiving structure 250 by pressing the coupling subsystem 240 toward the receiving structure 250, such that the posts 320 are coupled with the receiving structure 250, and the spring 330 is compressed from the length d2 to the length d1.

In some embodiments, the coupling subsystem 240 further comprises suitable electrical connection mechanism(s) to provide power management and/or signal transmission between the speaker 210 and the head-mounted display 110.

In some embodiments, the one or more components of the coupling subsystem 240 are made of materials such as beryllium copper, gold, nickel, steel, stainless steel, polytetrafluoroethylene (PTFE), acetyl copolymer, polycarbonate, other polymers and other metals.

The coupling subsystem 240 as can be used for attaching the speaker 210 to the strap 120, and detaching the speaker 210 from the strap 120 of the head-mounted display 110. The coupling subsystem 240 enables the speaker 210 to be removed from the user's ear without taking off the strap 120 and head-mounted display 110.

In some embodiments, the audio subsystem 200 offers multiple degrees of freedom to adjust the position of the speaker 210 to fit different users. The adjustments with multiple degrees of freedom include, but are not limited to, pivoting inward and outward relative to the user's ear, rotating within a vertical plane, and sliding upward and downward to adjust the height of the speaker 210. Various embodiments of the multiple degrees of freedom and related structures are described in U.S. patent application Ser. No. 14/627,639.

Figure 7:
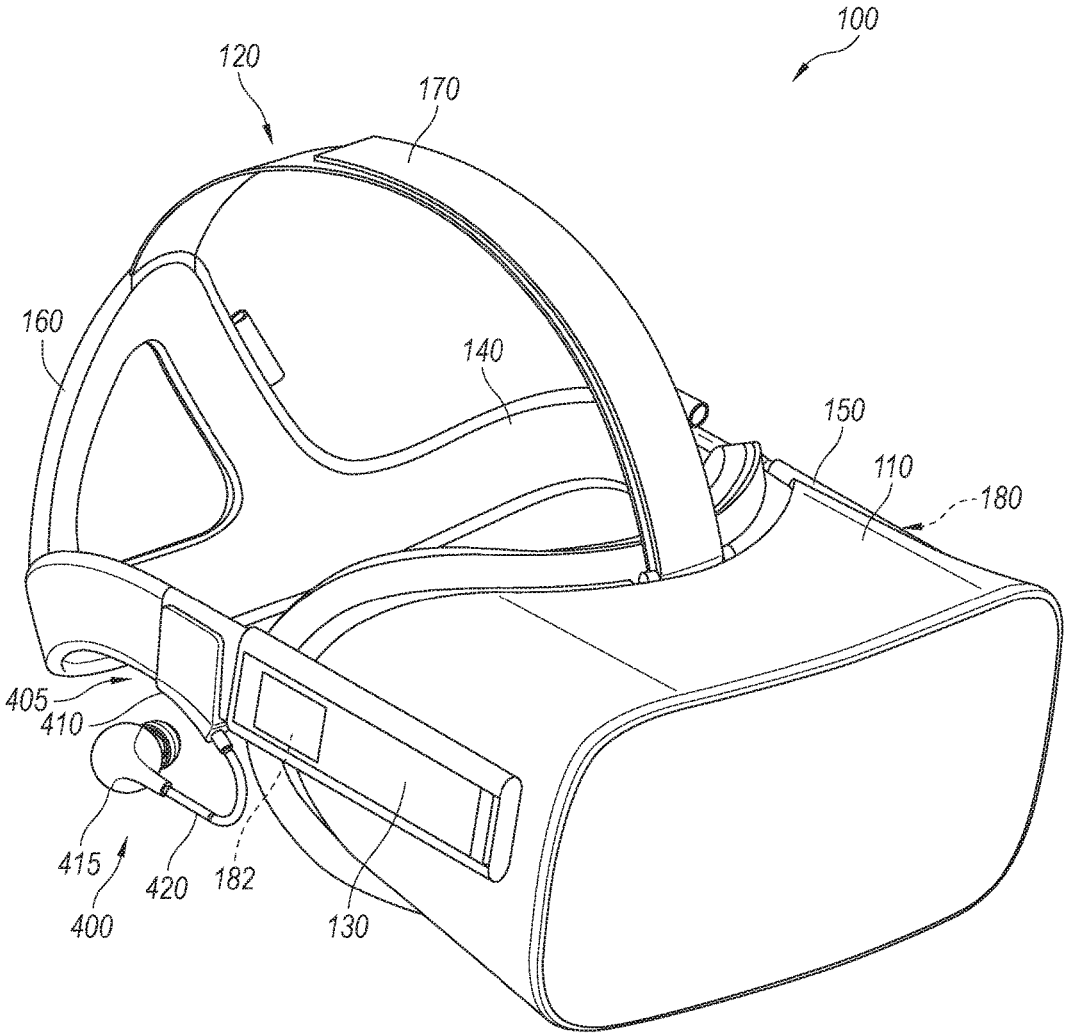
FIG. 7 is a perspective view of a head-mounted display integrated with an audio subsystem in accordance with one or more embodiments.

FIG. 7 is a perspective view of the head-mounted display system 100 integrated with an audio subsystem 400 in accordance with another embodiment. The head-mounted display system 100 has the strap 120 attached to the head-mounted display 110 at the side segments 130 and 150. Each of the side segments 130 and 150 has electrical lines 182 (e.g., wires) or other portions of the electrical connection mechanisms 180 therein that are operatively connected to the head-mounted display 110. The audio subsystem 400 is coupled to the electrical connection mechanism 180 at the side segments 130 and 150 via the electrical lines 182.

Figure 8:
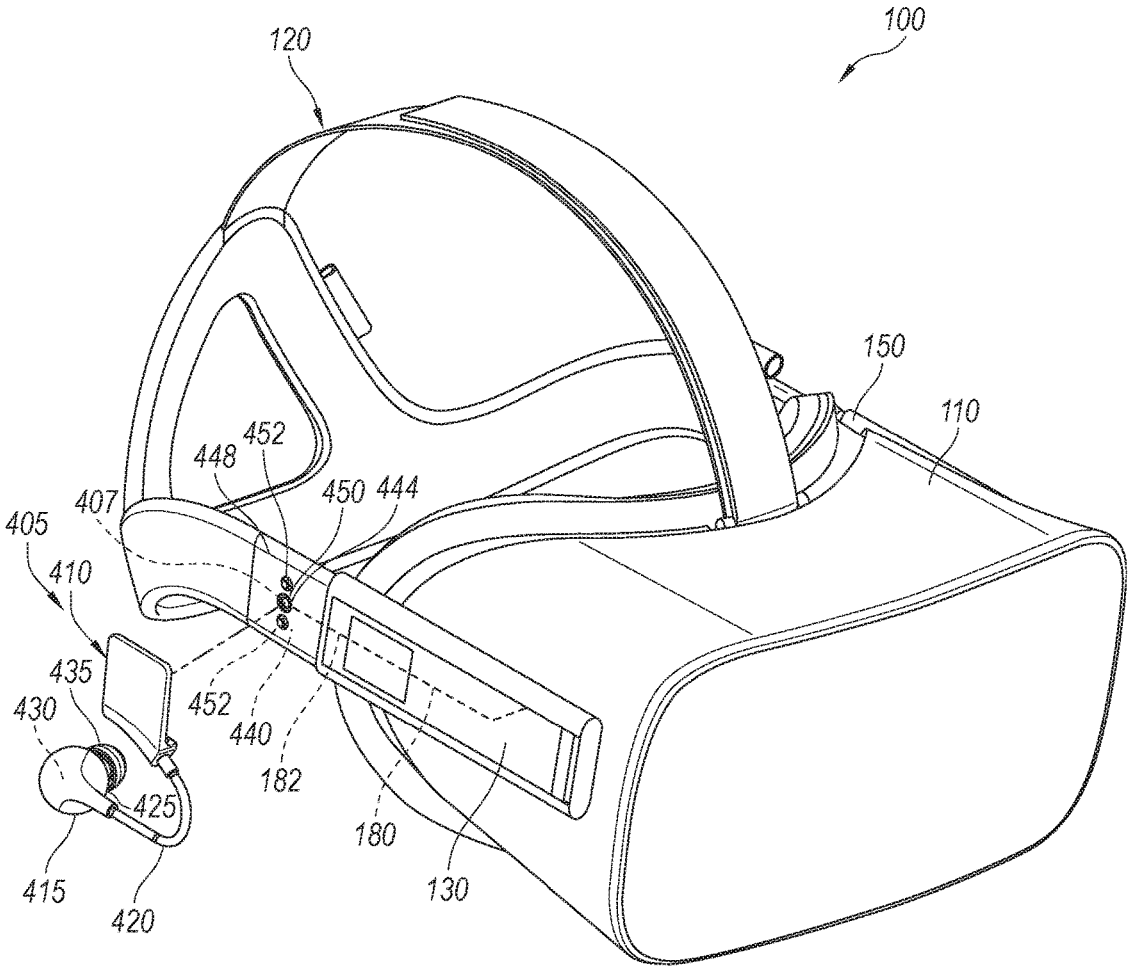
FIG. 8 is a partially exploded perspective view of the head-mounted display and audio subsystem of FIG. 7 with the connector plate assembly and earbud shown relative to a strap side segment.

FIG. 8 is a partially exploded perspective view of the audio subsystem 400 with a coupling subsystem 405 on each of the side segments 130 and 150. Each coupling subsystem 405 has a connection interface plate 407 mounted to the respective side segment 130/150 and operatively connected to the electrical lines 182 in the side segment. Another portion of the coupling subsystem 405 is a connector plate assembly 410 detachably connectable to the connection interface plate 407. The connector plate assembly 410 is connected to an earbud assembly 415 or other audio speaker assembly, by a flexible audio line or cable 420, such as a shielded earbud wire. The earbud assembly 415 has a contoured housing 425 that contains a speaker unit 430, which is operatively connected to the flexible audio line 420, and that carries a soft, flexible tip portion 435 configured to snugly fit into the wearer's ear. The connector plate assembly 410 and the earbud assembly 415 are detachable from the strap side segment 130 as a unit.

Figure 9:
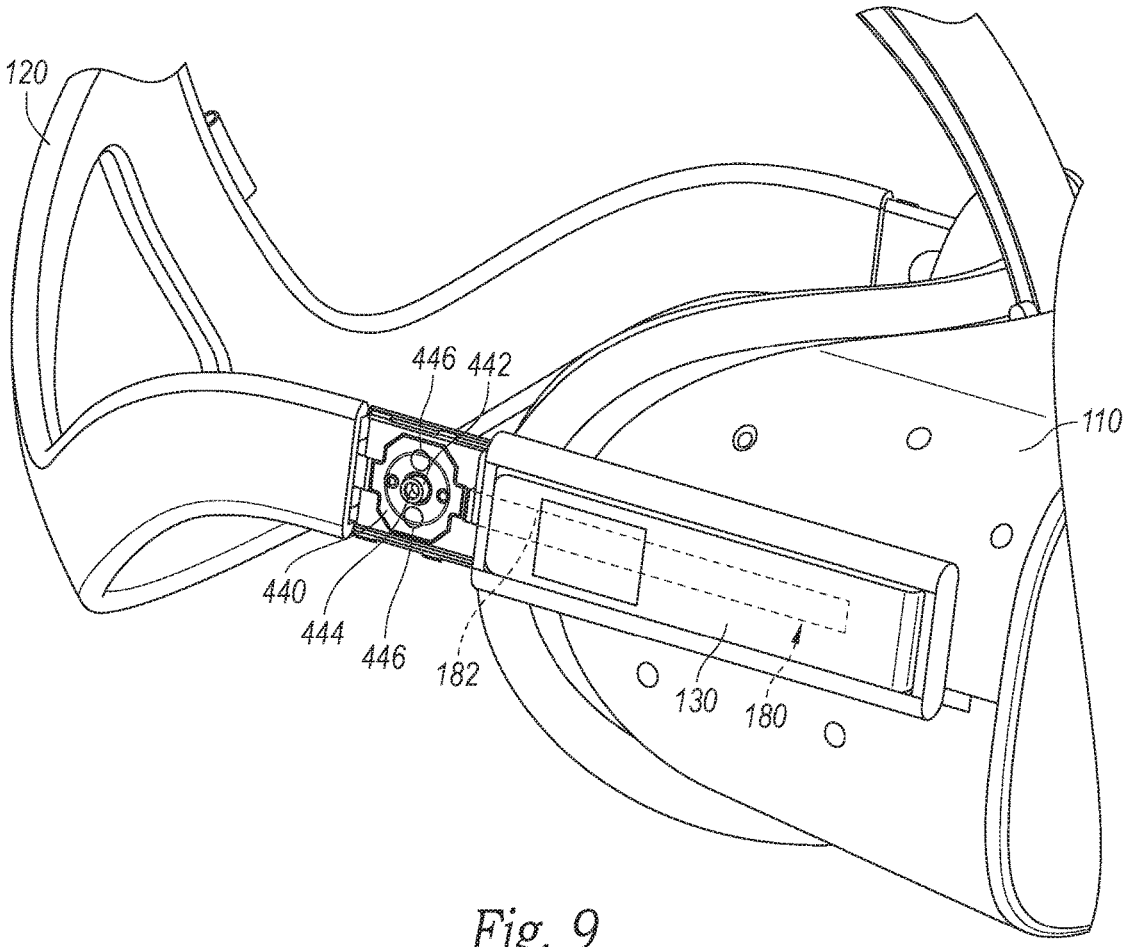
FIG. 9 is an enlarged, partial cutaway view of a strap side segment of the head-mounted display of FIG. 8, with a connector plate in the strap side segment.

While only one side of the coupling subsystem 405 is referred to below, it is to be understood that the description applies to both sides of the coupling subsystem 405. FIG. 9 is an enlarged, partial cutaway view of the strap side segment 130 of the strap 120. The illustrated strap side segment 130 contains an interface plate 440 that has a central aperture 442 that receives an internally threaded boss 444 extending partially through the strap side segment 130. In the illustrated embodiment, the boss 444 has a head portion accessible from the inner surface of the strap side segment 130 to allow a user to manually rotate the boss 444 within the aperture relative to the interface plate 440.

The interface plate 440 also has a pair of electrical contacts 446 on opposing sides of the central aperture 442, such that the electrical contacts 446 and the boss 444 are arranged linearly. The electrical contacts 446 are operatively coupled to the electrical lines 182 of the electrical connection mechanisms 180 in the strap side segment 150. As seen in FIG. 8, the strap side segment has a covering portion 448 that substantially covers the interface plate 440. The cover portion 448 has a through hole 450 that provides access to the boss 444, and a pair of access apertures 452 that provide access to the electrical contacts 446 (FIG. 9).

Figure 10:
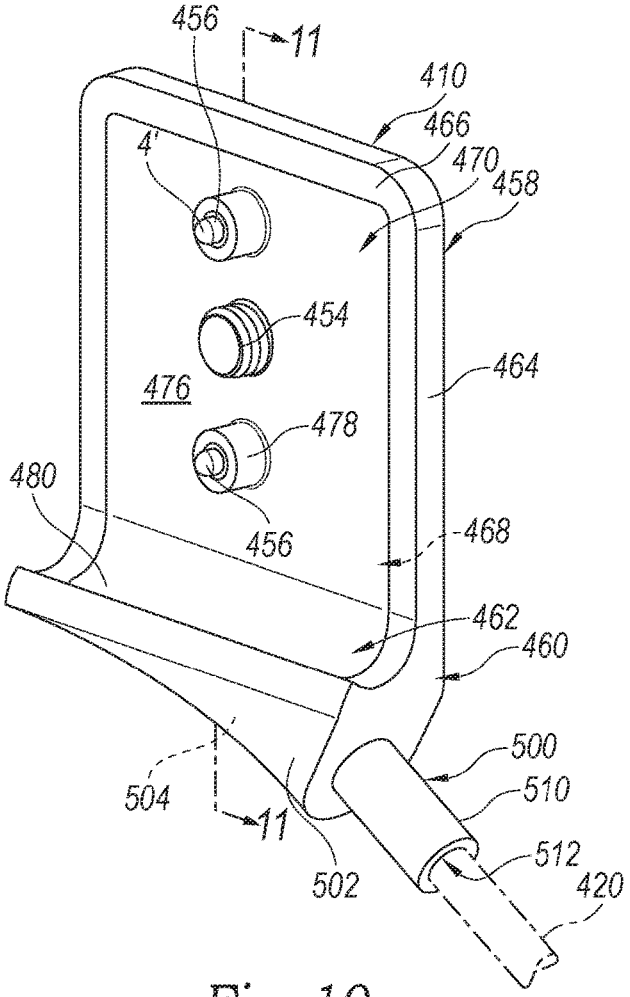
FIG. 10 is an enlarged front perspective view of the connector plate assembly of the audio subsystem of FIG. 8.
Figure 11:
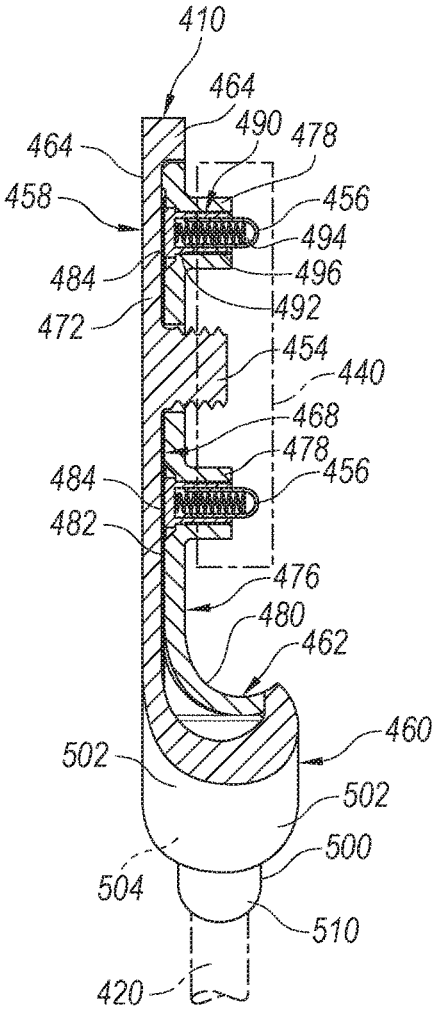
FIG. 11 is a cross-sectional view taken substantially along lines 11-11 of FIG. 10.

The connector plate assembly 410 of the audio subsystem 400 releasably connects to the interface plate 440 to provide independent electrical and mechanical interface with the side strap segment 130. As seen in FIGS. 10 and 11, the illustrated connector plate assembly 410 has a threaded attachment member, such as a threaded post 454, that mates with the threaded boss 444 of the interface plate 440 (FIG. 9). Accordingly, the two plate structures mechanically screw together to capture a portion of the side strap segment 130 therebetween. The connector plate assembly 440 is removable from the strap side segment 130 by unscrewing the threaded boss 444 from the threaded post 454.

The connector plate 410 also has a pair of electrical connectors 456 on opposing sides of the threaded post 454, such that the electrical connectors 456 are independent of the threaded post 454. The electrical connectors 456 are sized and positioned to extend through the access apertures 452 and firmly engage the electrical contacts 446 of the interface plate 440 (FIG. 9) to achieve positive electrical engagement with the electrical lines 182 in the side segment 130. In the illustrated embodiment, the electrical connectors 456 and the threaded post 454 are positioned in a linear arrangement, shown as a vertically linear arrangement, that provide for independent mechanical and electrical interconnection with the interface plate 440.

The connector plate assembly 410 has a generally planar upper portion 458 and a lower portion 460 integrally attached to and projecting away from the planar upper portion 458, both of which define a contoured support surface 462 shaped and sized to support a bottom edge of the strap side segment 130 when the connector plate assembly 410 is attached to the interface plate 440. The support surface 462 works with the linearly aligned electrical connectors 456 and threaded post 454 to resist torsional loads and substantially prevent rotational movement of the connector plate assembly 410 relative to the strap side segment 130.

As seen in FIGS. 10 and 11, the connector plate assembly 410 has an outer plate structure 464 with an outer rim portion 466 that defines a recessed receiving area 468 that receives a nonconductive contoured insert 470. In the illustrated embodiment, the outer plate structure 464 is a die cast metal unit that provides positive stiffness and rigidity to the connector plate assembly 410 and the insert 470 is made of a molded nonconductive plastic material. The illustrated threaded post 454 is integrally connected to a planar upper portion 472 (FIG. 11) of the outer plate structure 464.

Figure 12:
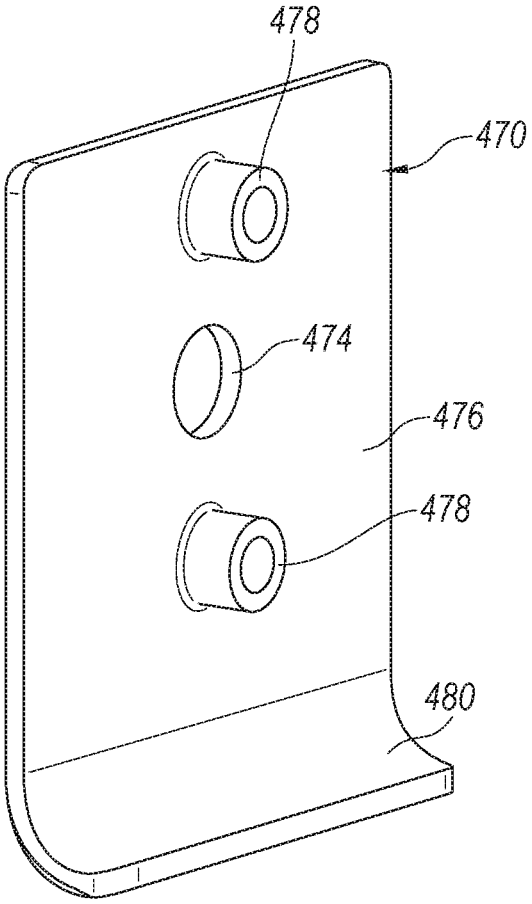
FIG. 12 is a perspective view of the nonconductive insert of the connector plate assembly of FIG. 10.

FIG. 12 is a perspective view of the nonconductive insert 470 of the connector plate assembly 410 shown removed from the outer plate structure 464. The insert 470 has a central aperture 474 positioned and sized to extend over the threaded post 454 (FIG. 10), such that the threaded post 454 projects beyond a planar strap-engaging surface 476 of the insert 470. The insert 470 also has a pair of hollow, cylindrical bosses 478 integrally connected to and extending from the strap engaging surface 476. The insert 470 also has a contoured lower projecting portion 480 that defines a portion of the strap support surface 462. The insert 470 is sized to press fit into the receiving area 468 (FIG. 10) for a secure interconnection between the insert 470 and the outer plate structure 464. The insert 470 can also be secured to the outer plate structure 464 with an adhesive to retain the insert 470 in the receiving area 468, such that the strap engaging surface 476 is substantially coplanar with the outer surface of the outer rim portion 466.

Figure 13:
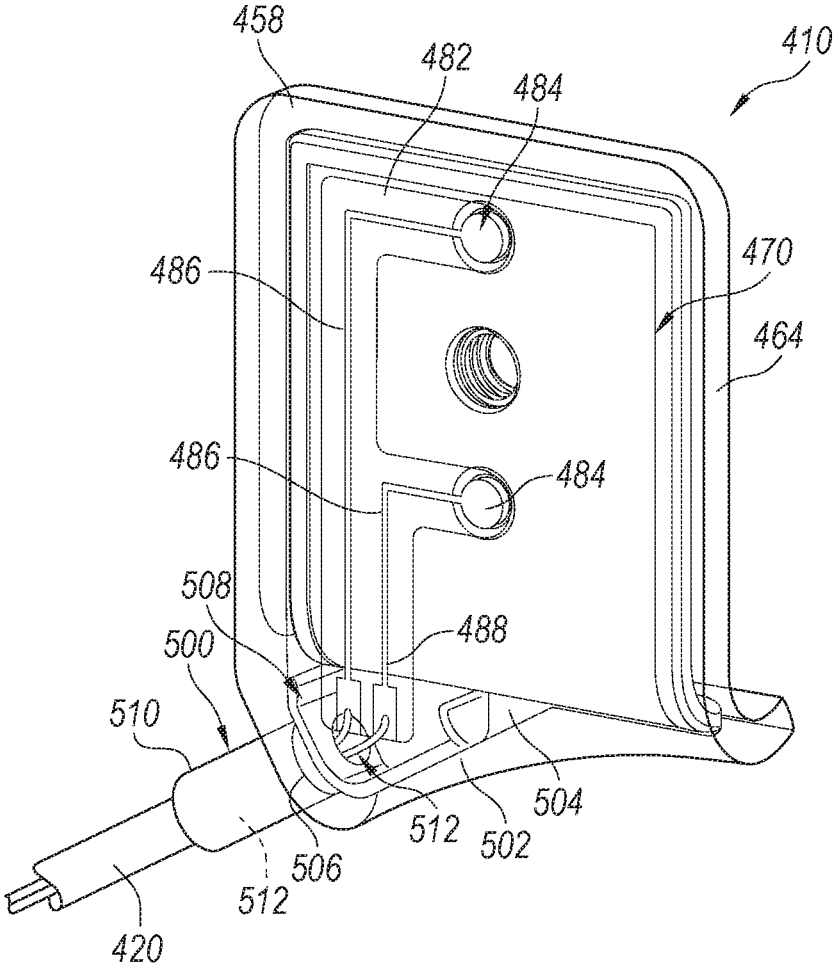
FIG. 13 is a rear perspective view of the connector plate assembly of FIG. 10, with portions shown as translucent for purposes of discussion.

FIG. 13 is a rear perspective view of the connector plate assembly 410 with portions shown as translucent for purposes of discussion. The connector plate assembly 410 has a flex circuit 482 captured between the insert 470 and the outer plate structure 464. The flex circuit 482 has a pair of electrical contact pads 484 positioned in axial alignment with the hollow bosses 478 of the insert 470 (FIG. 11). The contact pads 484 are connected to electrical wires or traces 486 that extend to a lower connection portion 488 positioned in the lower portion of the connector plate assembly 410.

As seen in FIG. 11, the connector plate assembly 410 has a pair of spring biased pogo pin electrical connectors 490 captured in the bosses 478 and soldered or otherwise electrically fixed to the contact pads 484 of the flex circuit 482. Each pogo pin connector 490 has a base 492 attached to a respective one of the contact pads 484, and a telescoping tip portion 494 slidably disposed in the base 492 and partially projecting out of the bosses 478. A spring 496 or other biasing member is contained within each pogo pin connector 490 between the base 492 and the tip portion 494 to urge the tip portion 494 axially away from the contact pads 484 so as to protrude through the bosses 478 when the pogo pin connector 490 is in a substantially uncompressed position. Accordingly, when the connector plate assembly 410 is attached to the strap side segment 130, the tip portion 494 of each pogo pin connector 490 extends through a respective one of the access apertures 452 (FIG. 8) and engages the electrical contacts 446. The spring 496 cause the tip portion 494 of the pogo pin connector 490 to press against the respective electrical contact 446 of the interface plate 440 to maintain electrical engagement during use of the head-mounted display system 100.

Referring again to FIG. 13, the connector plate assembly 410 has a flexible strain relief member 500 attached to the lower portion 502 of the outer plate structure 464. In the illustrated embodiment, the lower portion 502 has a chamber area 504 below the insert 470, and an aperture 506 in communication with the chamber area 504. The flexible strain relief member 500 has an upper portion 508 positioned within the chamber 504, and a lower portion 510 protruding through the aperture 506 and beyond the lower portion 502 of the outer plate structure 464. A wire channel 512 extends through the strain relief member 500 between the upper and lower portions 508 and 510 to provide access into the chamber 504.

In the illustrated embodiment, the strain relief member 500 has an enlarged contoured upper portion 508 positioned in the chamber 504 adjacent to the lower connection portion 488 of the flex circuit 482. The strain relief member 500 securely connects to an upper portion of the audio line 420, which is securely and electrically connected to the lower connection portion 488 of the flex circuit 482. The audio line 420 extends through the wire channel 512, out of the lower portion of the strain relief member 500, and connects at its distal end portion to the earbud assembly 415 (FIG. 8). The lower portion 510 of the flexible strain relief member 500 can flex with the audio line 420 while significantly reducing strain on the audio line 420 within the chamber and at the connection with the flex circuit 482.

The foregoing description, for purpose of explanation, has been described with reference to specific embodiments. However, the illustrative discussions above are not intended to be exhaustive or to limit the scope of the claims to the precise forms disclosed. Many modifications and variations are possible in view of the above teachings. The embodiments were chosen in order to best explain the principles underlying the claims and their practical applications, to thereby enable others skilled in the art to best use the embodiments with various modifications as are suited to the particular uses contemplated.

We claim:

1. A detachable audio system coupleable to a strap, comprising:

a first mounting plate assembly having a first plate portion attachable to the strap, first and second electrical contacts connected to the first plate portion and spaced apart from each other, and a first threaded attachment member connected to the first plate portion and spaced apart from the first and second electrical contacts;

a second mounting plate assembly having a second plate portion removably connectable to the first mounting plate assembly with at least a portion of the strap therebetween, a second threaded attachment member projecting from the second plate portion and being configured to threadably mate with the first threaded attachment member to mechanically hold the first and second mounting plate assemblies together on the strap, first and second electrical connectors connected to the second plate portion and positioned to engage the first and second electrical contacts when the first and second threaded attachment members are in threaded engagement;

a speaker assembly coupled to the second mounting plate assembly, wherein the speaker assembly and the second mounting plate assembly are detachable from the strap as a unit.

2. The detachable audio system of claim 1 wherein the first threaded attachment member is a cylindrical boss rotatable relative to the first plate portion and having a threaded internal area configured to receive and threadably engage the second threaded attachment member to mechanically hold the first and second mounting plate assemblies together on the strap.

3. The detachable audio system of claim 1 wherein the second threaded attachment member is a threaded male post integrally connected to the second plate portion.

4. The detachable audio system of claim 1 wherein the strap has a bottom edge portion, and wherein the second plate portion has a contoured seat portion configured to support the bottom edge portion of the strap.

5. The detachable audio system of claim 1 wherein the strap has opposing first and second side surfaces and a bottom edge portion extending therebetween, and wherein the second plate portion has an engagement surface portion configured to engage the first side surface and having a contoured seat portion integrally connected to the engagement surface and configured to support the bottom edge portion of the strap.

6. The detachable audio system of claim 1, further comprising:

a flexible, electrically conductive line coupled to the first and second electrical connectors and operatively coupled at a distal end portion to the speaker assembly;

a flexible strain relief member attached to the second plate portion and having an internal channel therethrough that contains at least part of a proximal end portion of the electrically conductive line to reduce strain on an interconnection between the electrically conductive line and the first and second electrical connectors.

7. The detachable audio system of claim 6 wherein the first and second electrical connectors include spring biased connector pins connected to a flex circuit attached to the proximal end portion of the electrically conductive line extending from the flexible strain relief member.

8. The detachable audio system of claim 6 wherein the speaker assembly is an earbud configured for engagement with an ear of a user wearing the strap.

9. The detachable audio system of claim 6 wherein the second plate portion has an outer plate structure with an outer rim portion defining a receiving area, and a non-conductive insert contained in the receiving area and being substantially coplanar with the outer rim portion.

10. A detachable audio system coupleable to a strap, comprising:

a first mounting plate assembly having a first plate portion attachable to the strap, first and second electrical contacts spaced apart from each other and connected to the first plate portion, and a first threaded attachment member connected to the first plate portion and spaced apart from the first and second electrical contacts;

a second mounting plate assembly having a second plate portion removably connectable to the first mounting plate assembly with at least a portion of the strap therebetween, the second mounting plate assembly having an outer plate structure with a receiving area, a non-conductive insert in the receiving area, a second threaded attachment member projecting from the outer plate structure through the non-conductive insert, wherein the second threaded attachment member is configured to screw together and threadably mate with the first threaded attachment member to mechanically hold the first and second mounting plate assemblies together on the strap, first and second spring-biased electrical connectors at least partially captured between the non-conductive insert and the outer plate structure with contact tips protruding through the insert and positioned to engage the first and second electrical contacts when the first and second threaded attachment members are in threaded engagement, the second mounting plate assembly having a flex circuit connected to the insert in operative engagement with the spring-biased electrical connectors, and having a flexible strain relief member attached to the outer plate structure, the flexible strain relief member having an internal channel with a first end adjacent to the flex circuit and a second end spaced apart from the flex circuit;

an electrically conductive line extending through the internal channel and connected at a proximal portion to the flex circuit; and a speaker assembly attached to a distal portion of the electrically conductive line;

wherein the speaker assembly, the electrically conductive line and second mounting plate assembly are detachable from the strap as a unit upon unscrewing the first and second threaded attachment members.

11. The detachable audio system of claim 10 wherein the first threaded attachment member is a cylindrical boss with a threaded internal area configured to receive and threadably engage the second threaded attachment member.

12. The detachable audio system of claim 10 wherein the second threaded attachment member is a threaded male post integrally connected to the outer plate structure and extending through an aperture in the non-conductive insert.

13. The detachable audio system of claim 10 wherein the strap has a bottom edge portion extending therebetween, and wherein the second plate portion has a contoured seat portion configured to support the bottom edge portion of the strap.

14. The detachable audio system of claim 10 wherein the insert has a pair of cylindrical bosses each containing at least a portion of a respective one of the spring-biased electrical connectors, with the tip portion projecting beyond the cylindrical boss.

15. The detachable audio system of claim 10 wherein the spring biased connectors and the second threaded attachment member are collinear with the second threaded attachment member between the spring biased connectors.

16. The detachable audio system of claim 10 wherein the spring biased connectors are each spring biased electrical pogo pin connectors.

17. A head-mounted display assembly, comprising:

a head mounted display;

a strap assembly with opposing first and second side strap portions connected to the head-mounted display, the first and second side strap portions, each containing electronic circuitry coupled to the head-mounted display; and first and second audio systems operatively coupled to the electronic circuitry, each of the first and second audio systems being detachably connected to a respective one of the first and second side strap portions, each of the first and second audio systems, comprising:

a first mounting plate assembly having a first plate portion attachable to the side strap portion, first and second electrical contacts connected to the first plate portion and spaced apart from each other, and a first threaded attachment member connected to the first plate portion and spaced apart from the first and second electrical contacts;

a second mounting plate assembly having a second plate portion removably connectable to the first mounting plate assembly with the side strap portion therebetween, a second threaded attachment member projecting from the second plate portion and being configured to threadably mate with the first threaded attachment member to mechanically hold the first and second mounting plate assemblies together on the side strap portion, first and second electrical connectors connected to the second plate portion and positioned to engage the first and second electrical contacts when the first and second threaded attachment members are in threaded engagement; and a speaker assembly coupled to the second mounting plate assembly, wherein the speaker assembly and the second mounting plate assembly are detachable from the side strap portion as a unit.

18. The head-mounted display assembly of claim 17 wherein the strap has a bottom edge portion, and wherein the second plate portion has a contoured seat portion configured to support the bottom edge portion of the strap.

19. The head-mounted display assembly of claim 17 wherein the strap has opposing first and second side surfaces and a bottom edge portion extending therebetween, and wherein the second plate portion has a planar engagement surface portion configured to engage the first side surface and having a contoured seat portion extending away from the engagement surface supporting the bottom edge portion of the strap.

20. The head-mounted display assembly of claim 17, further comprising:

a flexible, electrically conductive line coupled to the first and second electrical connectors and operatively coupled at a distal end portion to the speaker assembly;

a flexible strain relief member attached to the second plate portion and having an internal channel therethrough that contains at least part of a proximal end portion of the electrically conductive line to reduce strain on an interconnection between the electrically conductive line and the first and second electrical connectors.

* * * * *